US008102270B2

(12) United States Patent
Gowda et al.

(10) Patent No.: US 8,102,270 B2
(45) Date of Patent: Jan. 24, 2012

(54) PATIENT POSITION APPARATUS AND METHOD

(75) Inventors: Raj K. Gowda, Corona, CA (US); Richard Jeff Garcia, Yucaipa, CA (US)

(73) Assignee: KAP Medical, Corona, CA (US)

( * ) Notice: Subject to any disclaimer, the term of this patent is extended or adjusted under 35 U.S.C. 154(b) by 215 days.

(21) Appl. No.: 12/109,904

(22) Filed: Apr. 25, 2008

(65) Prior Publication Data

US 2009/0265852 A1 Oct. 29, 2009

(51) Int. Cl.
*G08B 21/00* (2006.01)

(52) U.S. Cl. ..... 340/665; 5/713

(58) Field of Classification Search ..... 340/665, 340/666, 667; 5/710, 713
See application file for complete search history.

(56) References Cited

U.S. PATENT DOCUMENTS

| | | | | |
|---|---|---|---|---|
| 4,033,332 | A | 7/1977 | Hardway, Jr. et al. | |
| 4,179,692 | A | 12/1979 | Vance | |
| 4,474,185 | A | 10/1984 | Diamond | |
| 4,539,560 | A | 9/1985 | Fleck et al. | |
| 4,833,457 | A * | 5/1989 | Graebe, Jr. | 5/710 |
| 5,010,772 | A | 4/1991 | Bourland et al. | |
| 5,062,169 | A | 11/1991 | Kennedy et al. | |
| 5,184,112 | A * | 2/1993 | Gusakov | 340/666 |
| 5,410,297 | A | 4/1995 | Joseph et al. | |
| 5,808,552 | A | 9/1998 | Wiley et al. | |
| 5,844,488 | A * | 12/1998 | Musick | 340/666 |
| 6,025,782 | A | 2/2000 | Newham | |
| 6,067,019 | A | 5/2000 | Scott | |
| 6,094,762 | A * | 8/2000 | Viard et al. | 5/713 |
| 6,133,837 | A | 10/2000 | Riley | |
| 6,297,738 | B1 | 10/2001 | Newham | |
| 6,386,051 | B1 | 5/2002 | Yoshimi | |
| 6,493,888 | B1 | 12/2002 | Salvatini et al. | |
| 6,778,090 | B2 | 8/2004 | Newham | |
| 7,253,366 | B2 * | 8/2007 | Bhai | 177/45 |
| 2006/0272097 | A1 * | 12/2006 | Dionne et al. | 5/713 |
| 2007/0070684 | A1 | 3/2007 | Poulos | |
| 2009/0013475 | A1 * | 1/2009 | Friedrichs | 5/713 |

FOREIGN PATENT DOCUMENTS

| | | |
|---|---|---|
| DE | 4137631 | 5/1992 |
| DE | 199 30 818 | 5/2001 |
| DE | 10 2006 008598 | 8/2007 |
| WO | WO 97/36521 | 10/1997 |
| WO | WO 2006/023479 | 3/2006 |
| WO | WO 2006/116859 | 11/2006 |

OTHER PUBLICATIONS

International Search Report for International Application No. PCT/US09/35220, Jun. 17, 2009, 4 pp.
Written Opinion for International Application No. PCT/US09/35220, Jun. 17, 2009, 9 pp. Lee, Mark, Application Note 2394, "CapSense Best Practices," Jan. 14, 2008, 11 pp., Cypress Semiconductor Corp., San Jose, CA.
Kremin, Victor et al., Application Note 42851, "Proximity Detection in the Presence of Metal Objects," Jan. 25, 2008, 10 pp., Cypress Semiconductor Corp., San Jose, CA.

* cited by examiner

*Primary Examiner* — John A Tweel, Jr.
(74) *Attorney, Agent, or Firm* — Baker & Daniels LLP

(57) ABSTRACT

A patient position apparatus includes a plurality of sensing conductors and a control module operatively coupled to the sensing conductors. The sensing conductors are arranged along a substantially planar surface. The sensing conductors provide sensing information in response to a patient being within proximity of the sensing conductors. The control module selectively adjusts fluid pressure of at least one inflatable cell in response to the sensing information.

24 Claims, 13 Drawing Sheets

PATIENT POSITION APPARATUS AND METHOD

FIELD

The present disclosure generally relates to mattresses designed for use with patients, and more particularly, to mattresses designed for use with patients and that include inflatable cells which can be selectively inflated or deflated.

BACKGROUND

Both patients and patient service providers benefit from products that provide features that increase therapeutic effectiveness, provide additional benefits, provide greater patient comfort and/or reduce patient cost. Part of the patient care services provided by patient service providers includes the administering of certain therapies while a patient is in bed. Such therapies include those that are directly related to the damage caused to the skin of a patient due to long periods of time spent in bed. For example, moving the patients, while in bed, can help prevent, as well as cure, bed sores (decubitus ulcers). In addition, reducing the pressure that the bed exerts on the patient's skin can also help prevent, or cure, bed sores. This can be achieved by providing an inflatable mattress where the weight of a patient can be distributed over a wider area and therefore the pressure on the patient's skin can be greatly reduced, as compared with the pressures exerted by conventional mattresses. However, different patients have different body masses and/or physical characteristics and therefore require different fluid pressures in order to keep the patient elevated above the harder surface of the bed.

As such, it is desirable to strike a balance between having enough fluid pressure in the inflatable mattress to keep the patient elevated above the harder surface of the bed while not having too much pressure so that the inflatable mattress itself becomes too firm.

BRIEF DESCRIPTION OF THE DRAWINGS

The invention will be more readily understood in view of the following description when accompanied by the below figures, wherein like reference numerals represent like elements.

DETAILED DESCRIPTION

Figure 1:
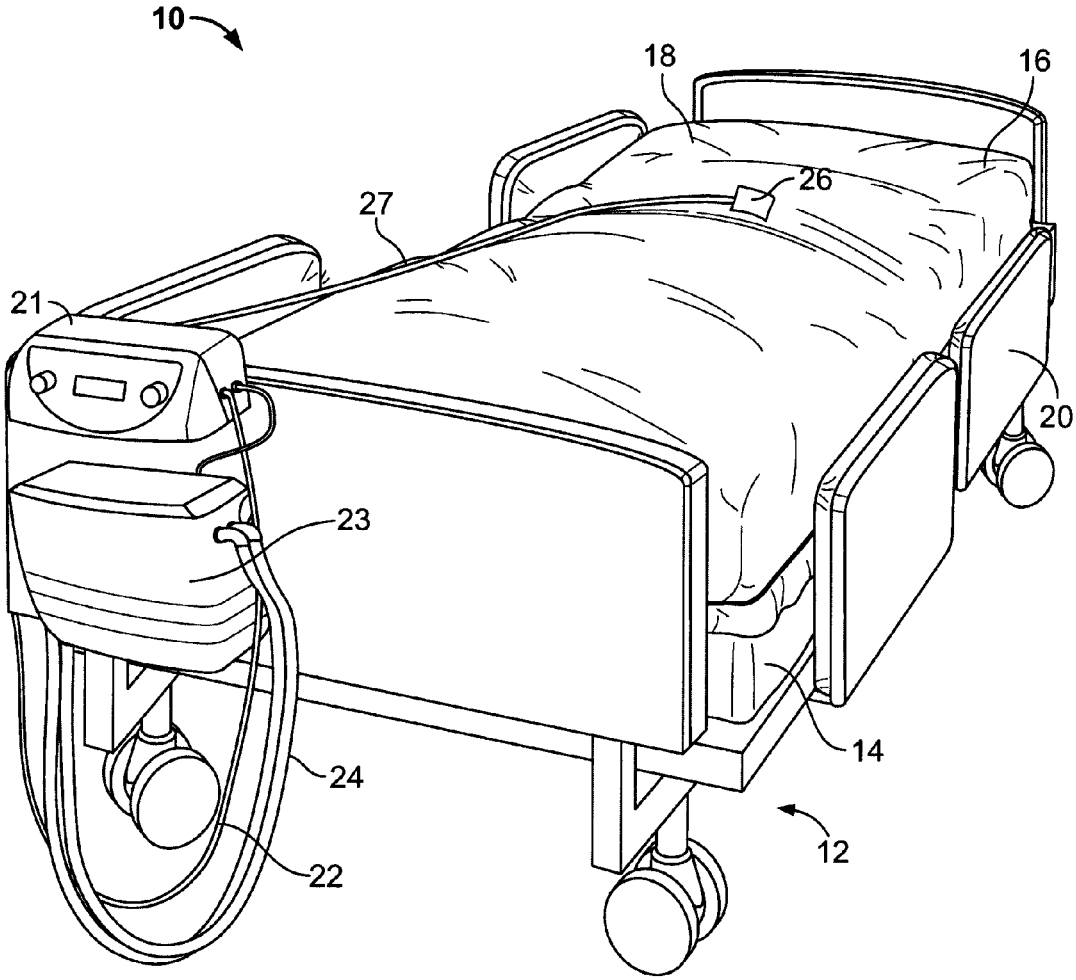
FIG. 1 is an exemplary bed that includes a patient support apparatus having a sonic percussion therapy apparatus.

In one example, a patient position apparatus includes a plurality of sensing conductors and a control module operatively coupled to the sensing conductors. The sensing conductors are arranged along a substantially planar surface. The sensing conductors provide sensing information in response to a patient being within proximity of the sensing conductors. The control module selectively adjusts fluid pressure of at least one inflatable cell in response to the sensing information. A related method is also disclosed.

The apparatus and method provide, among other advantages, a maintained predetermined position between a patient and the patient position apparatus, which is desirable for, inter alia, preventing and curing bedsores. In addition, the patient position apparatus and method can determine a position of the patient along the planar surface of the patient support apparatus, which can be used to alert personnel when the patient is positioned in an undesirable area (e.g. an edge of the patient support apparatus). Furthermore, the patient position apparatus and method can selectively adjust fluid pressure of inflatable cells of the patient support apparatus in order to roll the patient from an undesirable area (e.g. an edge of the patient support apparatus) to a desirable area (e.g. center of the patient support apparatus). Other advantages will be recognized by those of ordinary skill in the art.

In one example, the control module determines a distance between the patient and the plurality of sensing conductors based on the sensing information. In one example, the control module determines a relationship between the distance and the sensing information. In one example, the control module determines the relationship by inflating the at least one inflatable cell to a first inflation level and determining a first sensing value based on the sensing information at the first inflation level. The control module then subsequently inflates the at least one inflatable cell to a second inflation level and determines a second sensing value based on the sensing information at the second inflation level.

In one example, the control module increases the fluid pressure when the distance is less than a predetermined distance and decreases the fluid pressure when the distance is greater than the predetermined distance.

In one example, the control module determines a position of the patient along the substantially planar surface. In one example, the control module provides alarm information when the position of the patient is substantially along an edge of the substantially planar surface. In one example, the at least one inflatable cell includes a first and second inflatable chamber. The control module concurrently increases fluid pressure in the first chamber and decreases fluid pressure in the second chamber when the position of the patient is substantially along an edge of the substantially planar surface.

In one example, a patient support apparatus includes the at least one inflatable cell, the plurality of sensing conductors, and the control module.

As used herein, the term "module" can include an electronic circuit, one or more processors (e.g., shared, dedicated, or group of processors such as but not limited to microprocessors, DSPs, or central processing units) and memory that execute one or more software or firmware programs, combinational logic circuits, an ASIC, and/or other suitable components that provide the described functionality.

Referring now to FIG. 1, an exemplary bed 10 includes a support structure 12, such as a frame, a patient support apparatus 14, such as a mattress, that is supported by the support structure 12 and a fluid distribution support surface product 16. Although the patient support apparatus 14 is included in a bed in this example, those of ordinary skill in the art will appreciate that the patient support apparatus 14 can be used in other structures such as a chair, a wheelchair, or other suitable structure. In this example, the fluid distribution support surface product 16 serves as a type of inflatable top cover for a patient. As shown, the fluid distribution support surface product 16 has a planar surface 18 adapted to substantially cover the patient support apparatus 14. Also in this example, the bed includes side safety panels 20 and end safety panels as known in the art and also includes a therapy control module 21. The therapy control module 21 is operative to control percussion therapy via communication path 22 and/or other desirable therapies such as rotational therapy for example. Although the communication path 22 is a wired connection in this example, the communication path 22 can be a wireless connection or any other suitable connection.

In some embodiments, the therapy control module 21 can include a programmable fluid supply source 23 such as a programmable air loss pump as known in the art or other suitable fluid pump known in the art. The programmable fluid supply 23 provides low pressure fluid (e.g., air or other suitable fluid) through one or more tubes 24 to the fluid distribution support surface product 16. The programmable fluid supply source 23 need not be programmable and may be any suitable pump or other fluid supply source as desired. By way of example only, such a fluid supply source may be of a type sold by Kap Medical, Inc. located in Corona, Calif., USA, or any other suitable air supply source.

As shown, the fluid distribution support surface product 16 includes an accelerometer 26 operatively coupled to the planar surface 18. In one embodiment, the accelerometer 26 can be any known accelerometer capable of measuring acceleration in three dimensions. In other embodiments, the accelerometer 26 can be capable of measuring acceleration in one or two dimensions rather than three dimensions. The accelerometer 26 is operative to measure frequency and/or intensity information of vibrations provided during percussion therapy. The accelerometer 26 can provide the frequency and/or intensity information to the control module 21 via a wired connection 27 as shown or via any other suitable interface such as a wireless connection for example. The frequency and intensity information can then be used by the therapy control module 21 to selectively adjust the frequency and/or intensity of the percussion therapy. In some embodiments, the accelerometer 26 can be placed directly on the patient via sticky pads as known in the art or by other suitable known methods. In addition, the accelerometer 26 can determine a three-dimensional position (or other dimensional position) of the fluid distribution support surface product 16.

Figure 2:
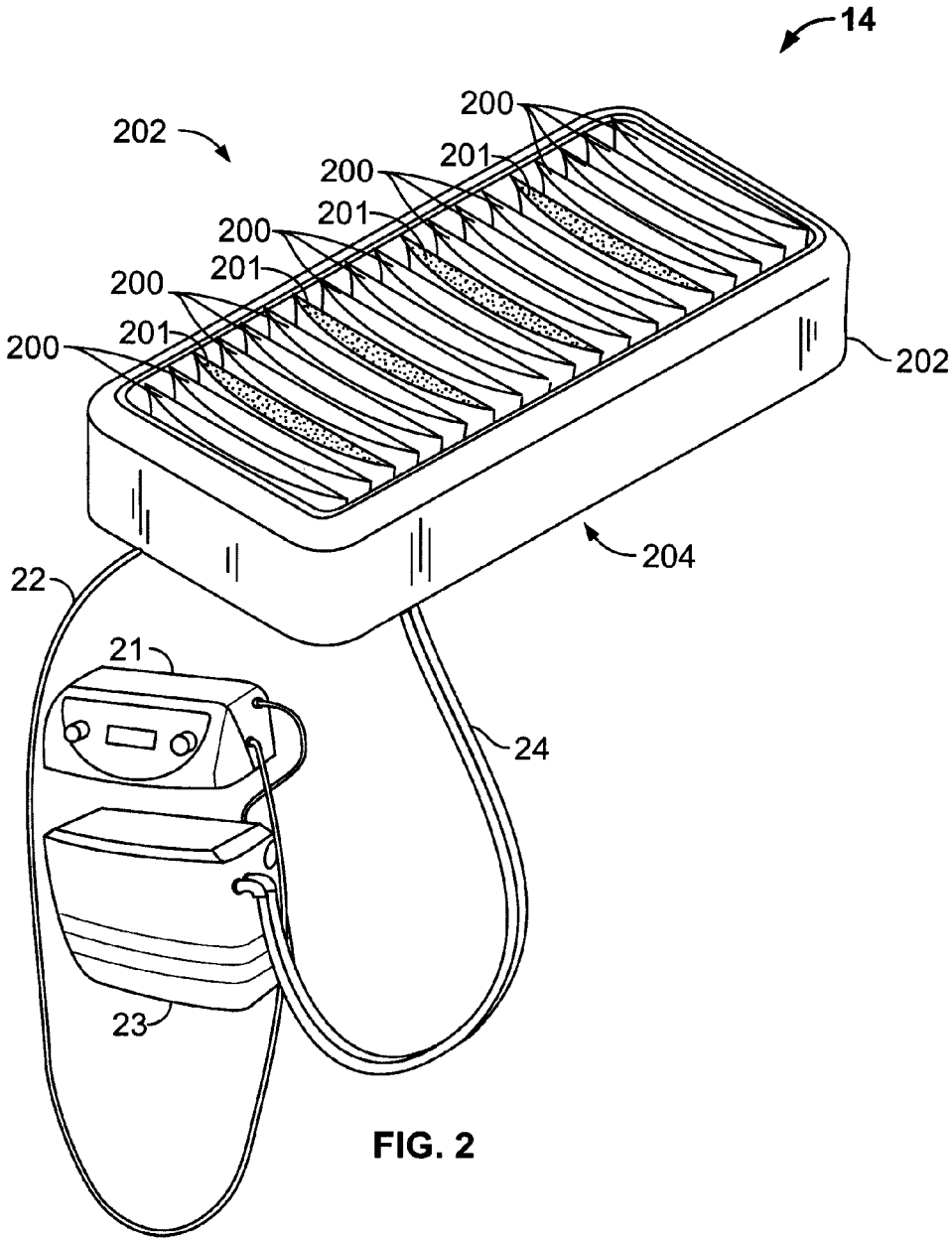
FIG. 2 is an exemplary diagram of the patient support apparatus.

Referring now to FIG. 2, an exemplary diagram of the patient support apparatus 14 is depicted. The patient support apparatus 14 includes a plurality of inflatable cells 200 and a plurality of sonic percussion therapy assemblies 201 within a frame 202. The inflatable cells 200 can be any suitable fluid resistant material known in the art. In this example, the patient support apparatus 14 includes four sonic percussion therapy assemblies 201 although more or less sonic percussion therapy assemblies 201 can be included. The sonic percussion therapy assemblies 201 in this example are arranged to provide percussion therapy to the upper chest, lower back, thigh, and calf of a patient. In some embodiments, it may be desirable to arrange one or more sonic percussion therapy assemblies 201 within the patient support apparatus 14 in order to provide percussion therapy to other locations of the patient.

The frame 202 includes a frame base 204 that extends throughout the open area between the frame 202. As shown, the frame 202, which in this embodiment is an inflatable frame, contains a plurality of inflatable cells 200. The inflatable cells 200 and sonic percussion therapy assemblies 201 rest upon the frame base 204. As shown, the top of the inflatable cells 200 and sonic percussion therapy assemblies 201 are not attached to the frame 202, nor are such tops restricted. The fluid distribution support surface product 16 is placed over what are shown here as exposed inflatable cushion cells 200 and sonic percussion therapy assemblies 201 such that the skin of the patient does not contact the inflatable cells 200 or sonic percussion therapy assemblies 201. The plurality of inflatable cells 200 inflate and deflate in response to the operation of the therapy control module 21.

Figure 3:
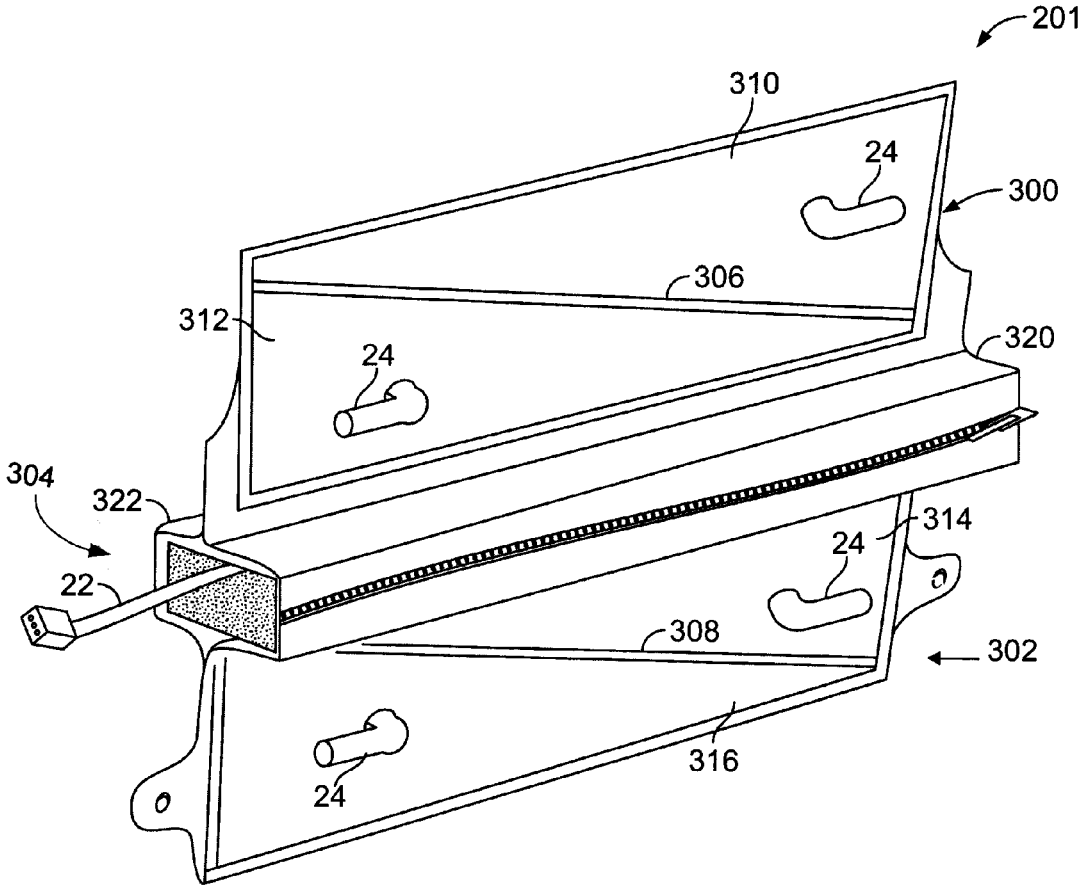
FIG. 3 is an exemplary diagram of a sonic percussion therapy assembly.

Referring now to FIG. 3, in one embodiment, each of the sonic percussion therapy assemblies 201 includes a first inflatable cell structure 300, a second inflatable cell structure 302, and a sonic percussion structure 304. The first and second inflatable cell structures 300, 302 can be made of any suitable fluid resistant material known in the art. As shown, the first and second inflatable cell structures 300, 302 are vertically stacked. In addition, the second inflatable cell structure 302 is beneath the first inflatable cell structure 300. The sonic percussion structure 304 is attached to the first inflatable cell structure 300 and the second inflatable cell structure 302 and disposed between the first inflatable cell structure 300 and second inflatable cell structure 302.

In this embodiment, the first inflatable cell structure 300 and the second inflatable cell structure 302 are operative to move the sonic percussion structure 304 in response to fluid pressure received via tubes 24. For example, the first inflatable cell structure 300 can inflate while the second inflatable cell structure 302 concurrently deflates and vice versa. In addition, the sonic percussion structure 304 is operative to provide a sonic percussive waveform in response to frequency information, intensity information, and/or other suitable information received via communication path 22.

In some embodiments, the first and second inflatable cell structures 300, 302 can be standard inflatable cells as known in the art. In other embodiments, the first and second inflatable cell structures 300, 302 can each include a diagonal seal 306, 308, respectively. When the first inflatable cell structure 300 includes the diagonal seal 306 two separate inflatable cells are formed 310, 312 as shown. Similarly, when the second label cell structure 302 includes the diagonal seal 308 two separate inflatable cells 314, 316 are formed as shown. As such, the therapy control module 21 can selectively inflate and deflate the inflatable cells 310, 312, 314, 316 in order to raise, lower, and/or rotate the planar surface 18 of the patient support apparatus 14 and the sonic percussion structure 304. For example, in order to rotate the sonic percussion structure 304, the therapy control module 21 can concurrently raise a first portion 320 and lower a second portion 322 of the sonic percussion structure 304 by selectively inflating and deflating the inflatable cells 310, 312, 314, 316. An example of an inflatable cell structure that includes a diagonal seal separating two separate inflatable cells is described in U.S. Pat. No. 7,171,711, which is hereby incorporated by reference in its entirety.

Figure 4:
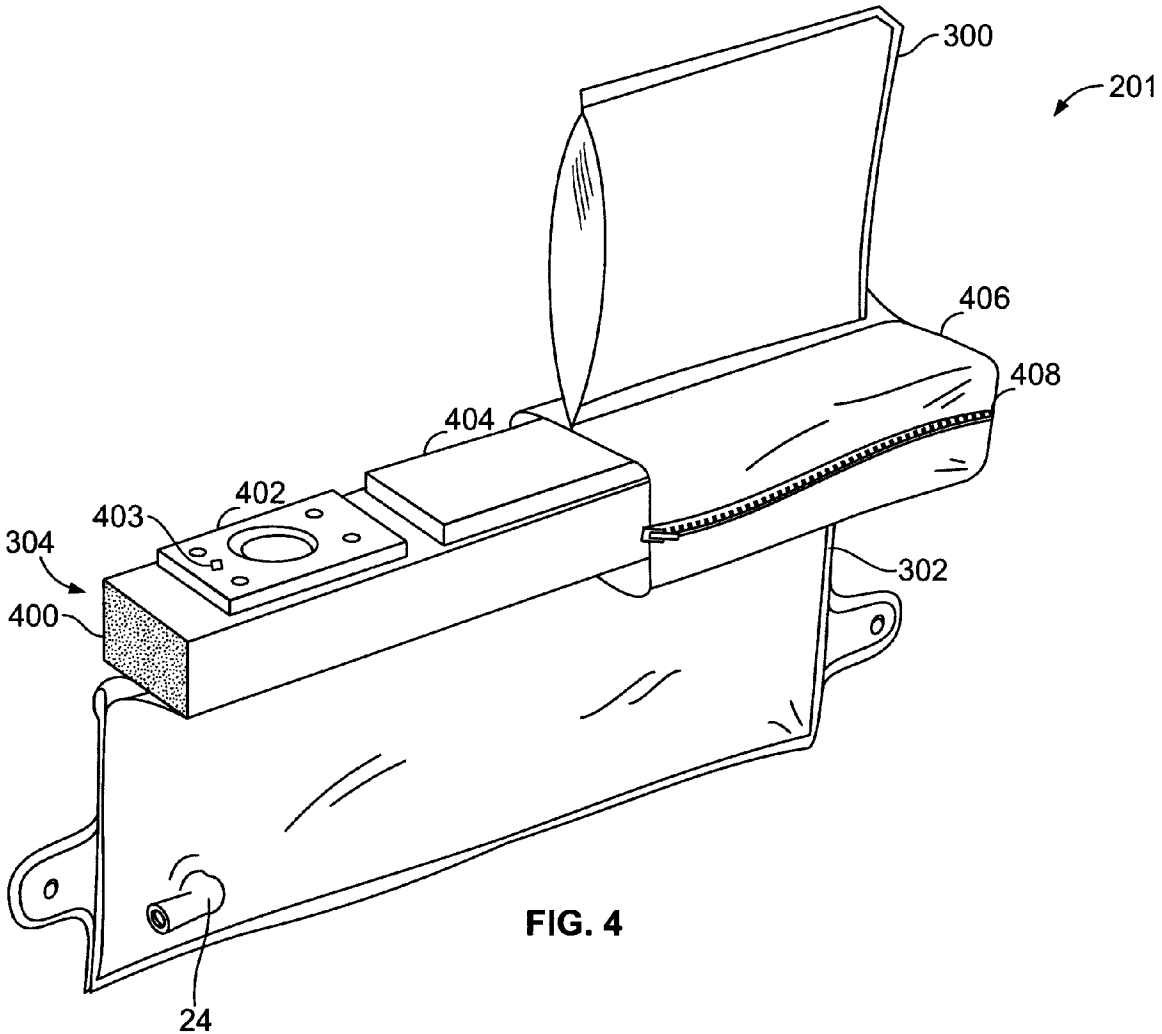
FIG. 4 is an exemplary cutaway diagram of another embodiment of the sonic percussion therapy assembly.

Referring now to FIG. 4, a cutaway view of the sonic percussion therapy assembly 201 is depicted. In this example, the first and second inflatable cell structures 300, 302 are standard inflatable cells and do not include the diagonal seal 306, 308. The sonic percussion structure 304 includes a base structure 400 that is substantially the same length as the first and second inflatable cell structures 300, 302. The base structure 400 can be made of any suitable material such as foam for example. The base structure 400 is operatively coupled to one or more sonic percussion speakers 402. The sonic percussion speakers 402 can be any suitable speaker capable providing sonic percussive waveforms and/or vibrations such as, for example, speakers sold by D2RM Corporation of Gardenia, Calif. having a part number 8002-01. In addition, the sonic percussion speakers 402 should be capable of providing a sonic percussive waveform having a frequency that is independent from the intensity of the waveform.

The sonic percussion speakers 402 provide a percussive waveform in response to frequency, intensity, and/or other suitable control information received via communication path 22. In one example, the frequency and/or intensity of the sonic percussive waveform can be controlled via a pulse width modulated signal. For example, in order to increase intensity of the sonic percussive waveform, a duty cycle of the pulse width modulated signal can be adjusted so that the speaker is on more often than in a previous duty cycle.

The therapy control module 21 controls the frequency, intensity, and/or duration of the percussive waveform in order to provide percussion therapy to the patient. The frequency, intensity, and/or duration of the percussive waveform can each be controlled independently by the therapy control module 21 via the communication path 22. As such, the therapy control module 21 can adjust the frequency, intensity, and/or duration of the percussive waveform to a unique setting for each individual patient. This is desirable because each patient may respond better to percussive waveforms at different frequencies and/or intensities based on their particular body mass and/or other physical characteristics.

In some embodiments, the control module 21 can automatically adjust the frequency, intensity, and/or duration of the percussive waveform in response to feedback information received from the accelerometer 26. In addition, each sonic percussion speaker 402 can be individually controlled so that one side of the patient can receive sonic percussion therapy while the other side does not receive sonic percussion therapy. This may be desirable, for example, when a user wishes to provide sonic percussion and or vibration therapy to one lung of a patient and not the other lung.

In some embodiments, a temperature sensor 403 can be operatively coupled to the speaker 402 to monitor operating temperature of the speaker 402. The operating temperature of the speaker 402 can be provided to the control module 21 via the communication path 22. The control module 21 can selectively disable the speaker 402 based on the operating temperature in order to prevent the speaker 402 from overheating.

The sonic percussion structure 304 can also include an additional top portion 404 in order to enclose the sonic percussion speaker 402 if desired. The top portion 404 can be made of any suitable material such as foam for example. In addition, the sonic percussion structure 304 can be attached to the first and second inflatable cell structures 300, 302, in any suitable manner. In this example, the sonic percussion structure 304 is disposed within a sheath 406 that is attached to the first and second inflatable cell structures 300, 302. In this example, the sheath 406 includes a zipper 408 so the sonic percussion structure 304 can be easily inserted into and removed from the sheath 406.

Figure 5:
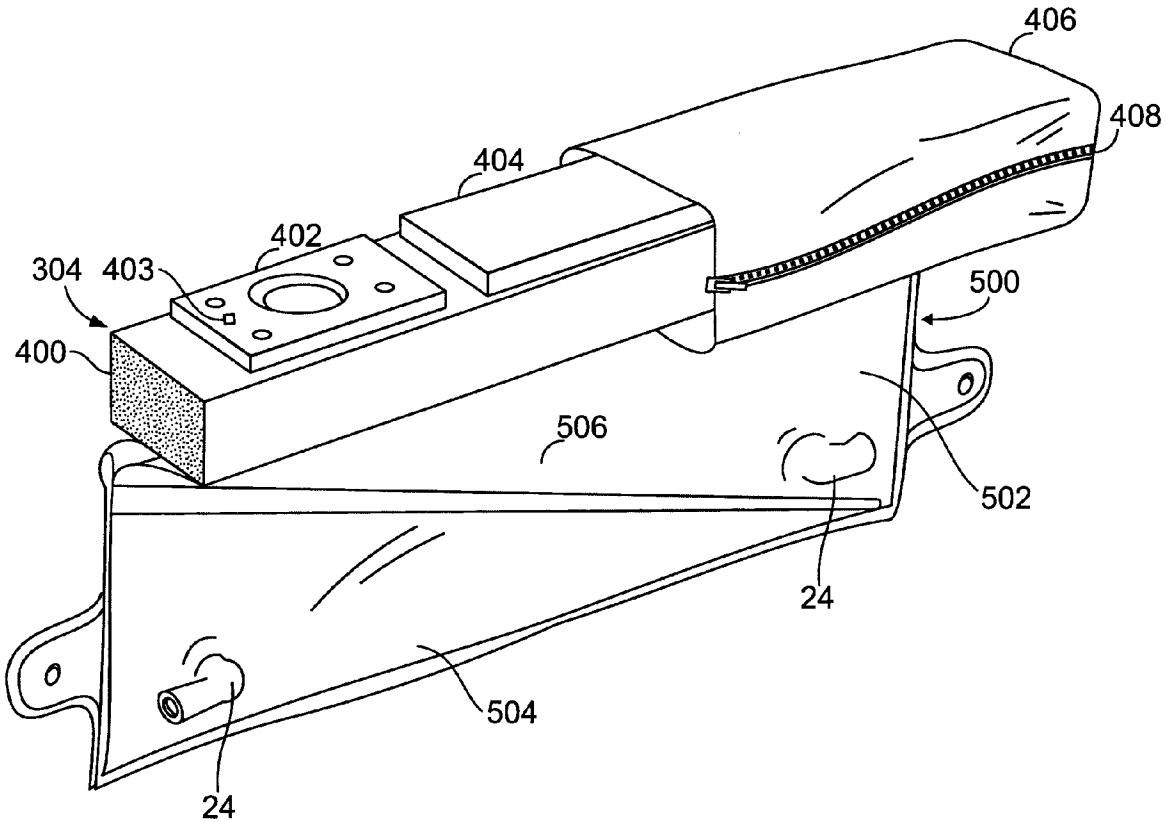
FIG. 5 is an exemplary cutaway diagram of another embodiment of the sonic percussion therapy assembly.
Figure 6:
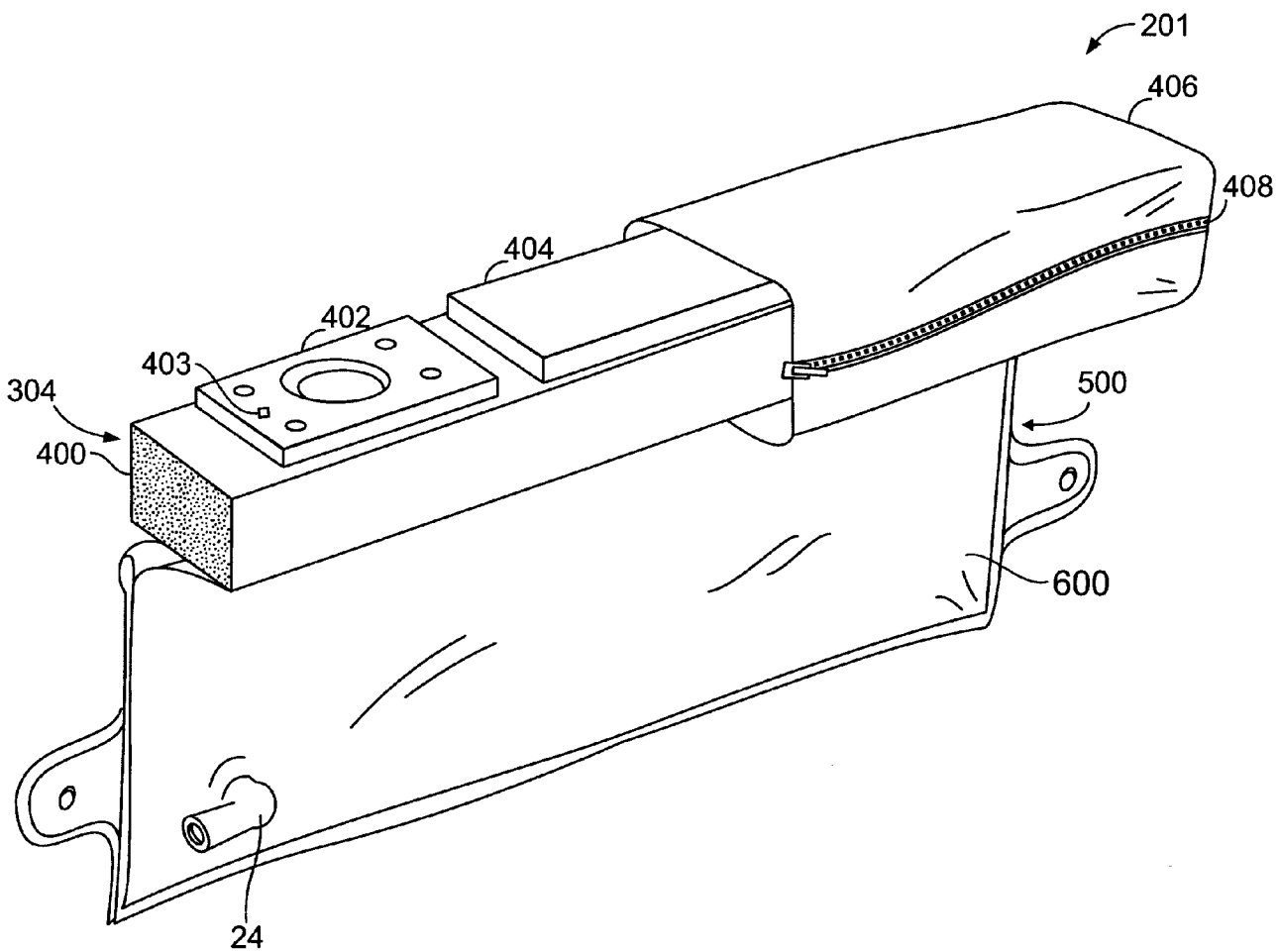
FIG. 6 is an exemplary cutaway diagram of another embodiment of the sonic percussion therapy assembly.
Figure 7:
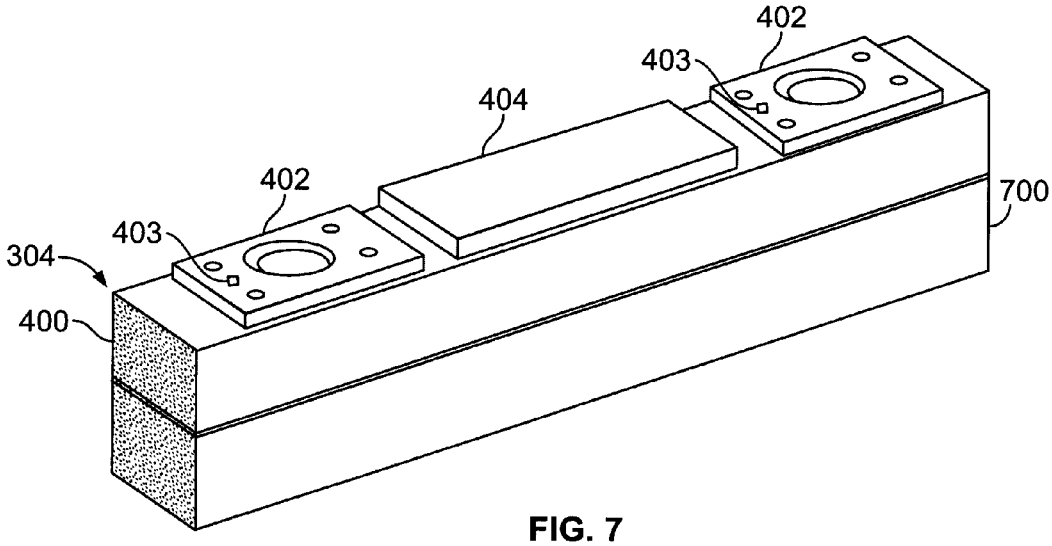
FIG. 7 is an exemplary diagram of yet another embodiment of the sonic percussion therapy assembly.

Referring now to FIGS. 5 and 6, alternative embodiments of the sonic percussion therapy assembly 201 are depicted. In these examples, the sonic percussion therapy assembly 201 includes an inflatable cell structure 500 attached to the sonic percussion structure 304. The inflatable cell structure 500 can be made of any suitable fluid resistant material known in the art. In addition, as with the first and second inflatable cell structures 300, 302 of FIG. 3, the inflatable cell structure 500 can include a single inflatable cell 600 as shown in FIG. 6 or two inflatable cells 502, 504 separated by a diagonal seal 506 as shown in FIG. 5. In addition, in some embodiments, the sonic percussion structure 304 can be attached to a base structure 700 as shown in FIG. 7. The base structure 700 can be made of any suitable material such as foam for example. As such, the sonic percussion structure 304 remains stationary during sonic percussion therapy in the embodiment shown in FIG. 7.

Figure 8:
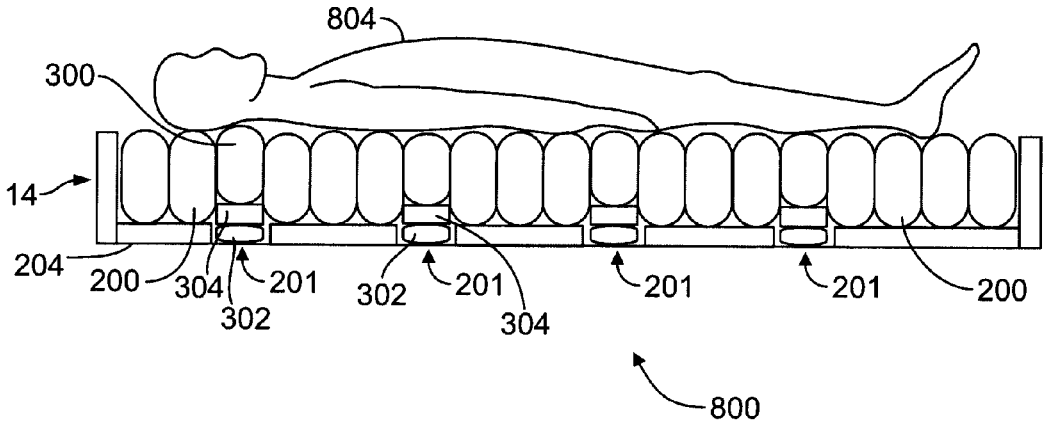
FIG. 8 depicts exemplary cutaway side views of the patient support apparatus when sonic percussion therapy is being provided and not being provided.
Figure 8:
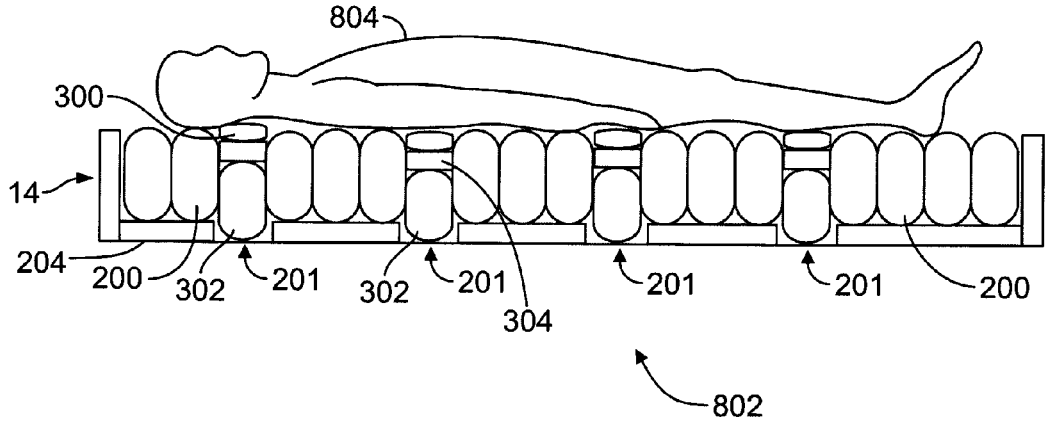

Referring now to FIG. 8, exemplary cutaway side views of the patient support apparatus 14 are generally identified at 800 and 802. The patient support apparatus 14 includes a plurality of the sonic percussion therapy assemblies 201. In this example, the patient support apparatus 14 includes four sonic percussion therapy assemblies 201 although more or less sonic percussion therapy assemblies 201 can be included. The sonic percussion therapy assemblies 201 in this example are arranged to provide percussion therapy to the upper chest, lower back, thigh, and calf of the patient 804. In some embodiments, it may be desirable to arrange one more sonic percussion therapy assemblies 201 within the patient support apparatus 14 in order to provide percussion therapy to other locations of the patient 802.

The patient support apparatus 14 generally identified at 800 illustrates the patient support apparatus 14 when the patient 804 is not receiving sonic percussion therapy treatment. As shown, the sonic percussion structure 304 is retracted (e.g. lowered) and not providing sonic percussion therapy to the patient 804. In some embodiments, the sonic percussion structure 304 is retracted within the frame base 204. Although the sonic percussion therapy assembly 201 in this example includes the first inflatable cell structure 300, the sonic percussion therapy assembly 201 does not need to include the first inflatable cell structure 300 as noted above with reference to FIGS. 5, 6, and 7.

The patient support apparatus 14 generally unidentified at 802 illustrates a patient support apparatus 14 when the patient 802 is receiving sonic percussion therapy treatment. As shown in this example, the sonic percussion structure 304 is extended (e.g. raised) toward the patient 802 and provides a sonic percussive waveform to the patient 802. As previously noted, the sonic percussion therapy assembly 201 can include the first inflatable cell structure 300 or, if desired, need not include the first inflatable cell structure 300.

Figure 9:
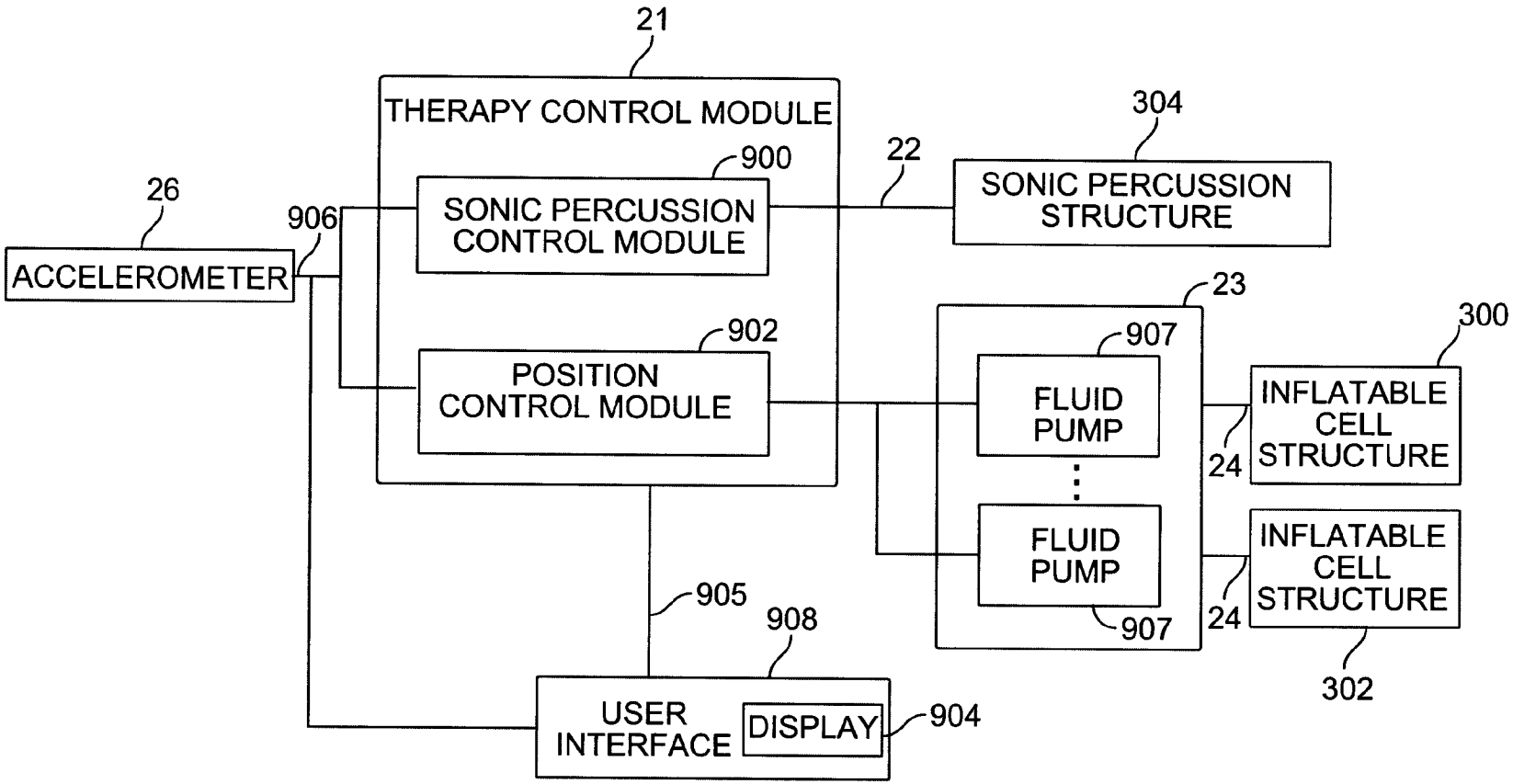
FIG. 9 is an exemplary functional block diagram of a therapy control module that controls a sonic percussion therapy assembly according to the present disclosure.

Referring now to FIG. 9, an exemplary functional block diagram of the therapy control module 21 is depicted. The therapy control module 21 includes a sonic percussion control module 900 and position control module 902. The sonic percussion control module 900 independently controls frequency and intensity of the sonic percussion structure 304. The position control module 902 selectively raises and lowers the sonic percussion structure 304 with respect to the planar surface 18.

The therapy control module 21 can also include a user interface 908 so that a user can interact with the therapy control module 21 via user control information 905 in order to provide therapy in the form of percussion, vibration, and/or rotational therapy. The user interface 1908 can also provide feedback information 906 received from the accelerometer 26 to a user via a display 904. The feedback information 906 can include, among other things, frequency, intensity, therapy duration, position of the planar surface 18, and/or any other suitable information. In addition, the user interface 1908 and the therapy control module 21 can be included in one unit if desired.

In addition, the sonic percussion control module 900 and the position control module 902 can receive the feedback information 906 in order to automatically adjust the sonic percussion therapy and/or rotational therapy provided by the patient support apparatus 14. For example, the sonic percussion control module 900 and sonic position control module 902 can each include a suitable feedback control module (not shown) such as, for example, a PI, a PD, a PID, and/or any other suitable feedback control module in order to adjust the sonic percussion therapy and/or rotational therapy to a desired therapy setting.

The sonic percussion control module 900 is operatively coupled to the sonic percussion structure 1304. The sonic percussion control module 900 controls the frequency, intensity, and/or duration of the sonic percussion therapy. As previously noted, the sonic percussion control module 900 can adjust the frequency independent of adjusting the intensity of the sonic percussion therapy. As such, the sonic percussion control module 900 can provide sonic percussion therapy that is customized to a particular patient.

Furthermore, the sonic percussion control module 900 can control each of the sonic percussion speakers 402 independently. In this manner the sonic percussion control module 900 can selectively provide sonic percussion therapy to particular areas of the patient 804. For example, the sonic percussion control module 900 can provide sonic percussion therapy to a left lung of the patient 804 without providing sonic percussion therapy to a right lung of the patient 804.

The programmable fluid supply source 23 can include one or more fluid supply pumps 907. Each of the fluid supply pumps 907 are in fluid communication with a respective inflatable cell structure 908. For example, when the sonic percussion therapy assemblies 201 include the first and second inflatable cell structures 300, 302, a first of the fluid supply pumps 907 is in fluid communication with the first inflatable cell structure 300 and a second of the fluid supply pumps 907 is in fluid communication with the second inflatable cell structure 302. As such, the position control module 902 can control the programmable fluid supply source 23 to inflate the first inflatable cell structure 300 and concurrently deflate the second inflatable cell structure 302 or vice versa. Those of ordinary skill in the art will appreciate that the fluid supply pumps 907 can be in fluid communication with any other suitable cell structure desired to be inflated and/or deflated.

Figure 10:
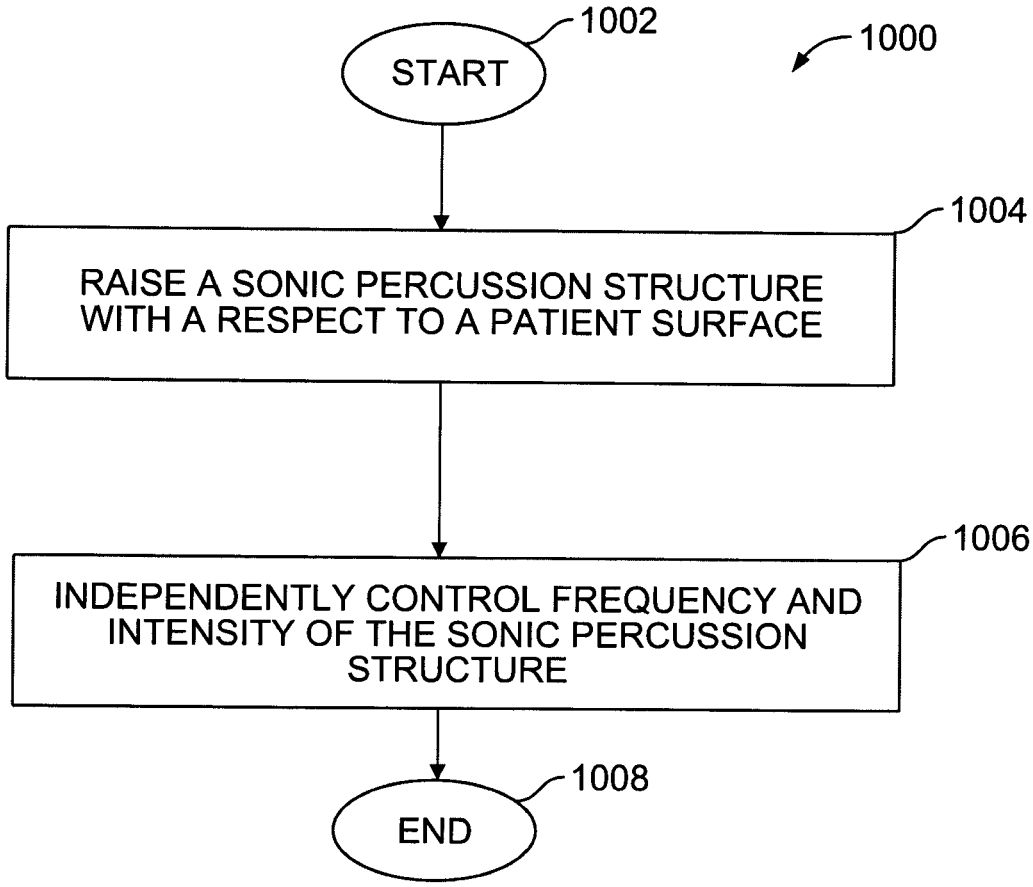
FIG. 10 is an exemplary flowchart depicting steps that can be taken by the therapy control module.

Referring now to FIG. 10, exemplary steps that can be taken by the control module 21 in order to provide percussion therapy are generally identified at 1000. The process starts in step 1002 when a user desires to provide sonic percussion therapy to a patient. In step 1004, the control module 21 raises the sonic percussion structure 304 with respect to a patient surface (e.g. the planar surface 18). In step 1006, the control module independently controls the frequency and intensity of the sonic percussion structure 304. The process ends in step 1008. As previously noted, the sonic percussion structure 304 can be lowered with respect to the patient surface (e.g. the planar surface 18) when sonic percussion therapy is not being provided.

Figure 11:
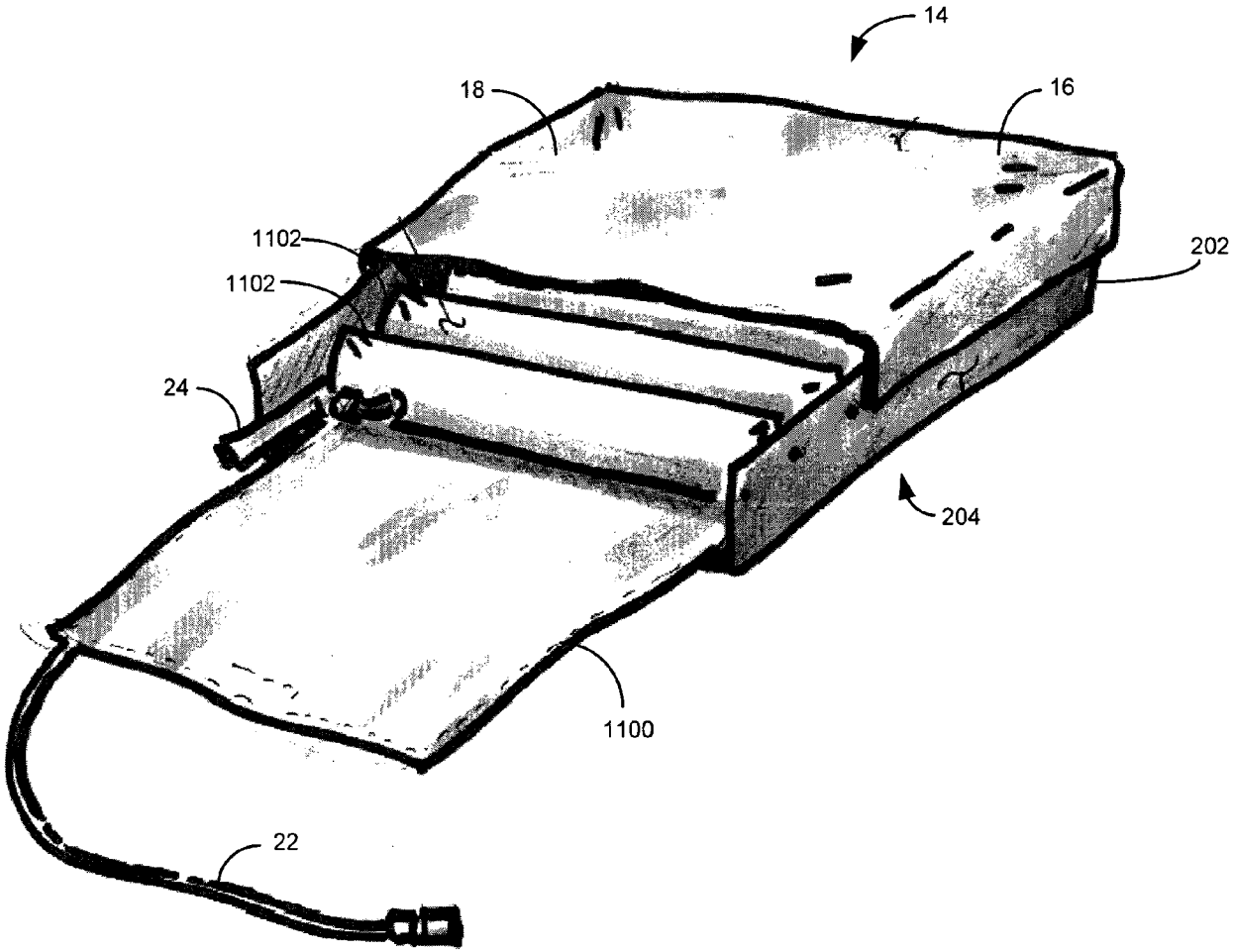
FIG. 11 is an exemplary diagram of the patient support apparatus having a patient position apparatus.

Referring now to FIG. 11, an exemplary diagram of the patient support apparatus 14 having a patient position apparatus 1100 is depicted. The patient position apparatus 1100 is disposed beneath inflatable cells 1102 as shown. As with the patient support apparatus 14, the patient position apparatus 1100 can be included in various structures such as a bed, a chair, a wheelchair, or other suitable structures. The inflatable cells 1102 correspond with inflatable cells 200, 300, 302, and/or 500 and form the substantially planar surface 18. As will be discussed in more detail below, the patient position apparatus 1100 senses proximity of the patient 804 and selectively adjusts fluid pressure of the inflatable cells 1102 based thereon so that a predetermined distance (e.g. 4 inches) can be maintained between the patient 804 and the patient position apparatus 1100. The patient position apparatus 1100 is also capable of determining a position (e.g. along the x and y axis) of the patient along the planar surface 18 of the patient support apparatus 14.

Figure 12:
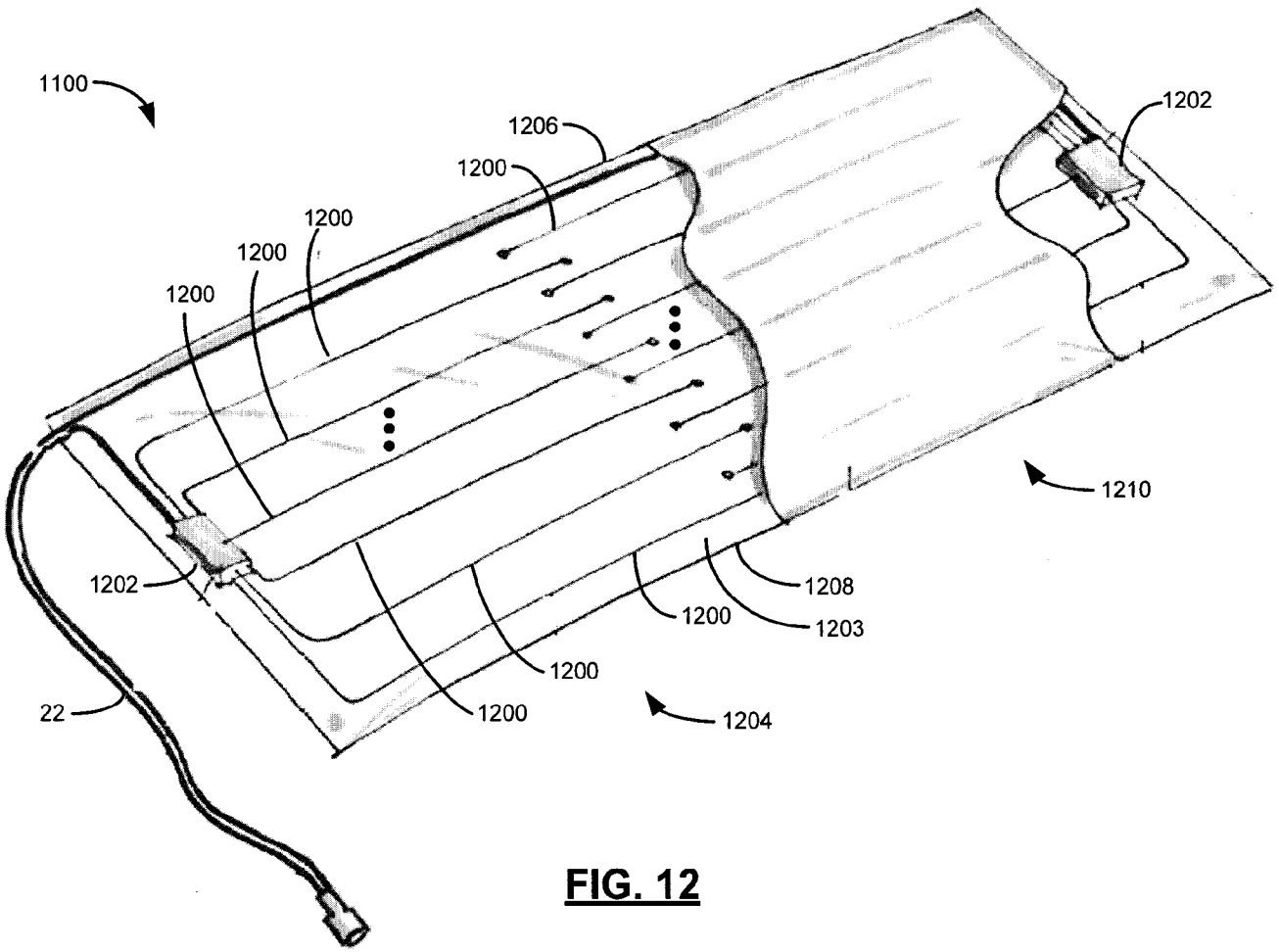
FIG. 12 is an exemplary cutaway diagram of the patient position apparatus.

Referring now to FIG. 12, an exemplary cutaway diagram of the patient position apparatus 1110 is depicted. The patient position apparatus 1100 includes a plurality of sensing conductors 1200 and one or more control modules 1202 operatively coupled to the sensing conductors 1200. In one example, each control module 1202 can be operatively coupled to six sensing conductors 1200 that are spaced apart and dispersed longitudinally along the patient position apparatus 1100 on a support surface 1203 although more or less sensing conductors 1200 can be used if desired. In one example, the control module 1202 can be a PSoC microcontroller sold by Cypress Semiconductor located in San Jose, Calif. although other control modules that perform described functionality can be used.

In one embodiment, the sensing conductors 1200 have an elongated shape as shown. The sensing conductors 1200 can be any suitable conductive material such as a conductive wire, a conductive strip, conductive ink, a metal strip, or other suitable conductive material capable of having an elongated shape. The sensing conductors 1200 provide sensing information in response to the patient 804 being within proximity of the sensing conductors 1200. More specifically, the sensing conductors 1200 provide the sensing information based on a capacitance between the sensing conductors 1200 and the patient 804. For example, when the patient 804 is further from the sensing conductors 1200, the capacitance is less than when the patient is closer to the sensing conductors 1200. In some embodiments, the sensing conductors 1200 can provide the sensing information based on an inductance as known in the art.

The control module 1202 selectively adjusts fluid pressure of the inflatable cells 1102 in response to the sensing information. More specifically, the control module 1202 determines a distance between the patient 804 and the sensing conductors 1200 and selectively increases and decreases the fluid pressure of the inflatable cells 1102 in order to maintain a predetermined distance (e.g. 4 inches) between the patient 804 and the sensing conductors 1200. As such, the control module 1202 increases the fluid pressure of the inflatable cells 1102 when the distance is less than the predetermined distance and decreases the fluid pressure of the inflatable cells 1102 when the distance is greater than the predetermined distance.

In one embodiment, the control module 1202 determines the distance based on known distances and sensing information sampled at the known distances. For example, each patient 804 that is resting on the inflatable cells 1102 will likely have a different body mass and/or other physical characteristics. As such, the control module 1202 can determine a relationship between distance and capacitance for each patient 804. The relationship can be determined by inflating the inflatable cells 1102 to a first inflation value and determining a first sensing value based on the sensing information. The control module 1202 can then subsequently adjust inflation of the inflatable cells 1102 to a second inflation value that is different from the first inflation value and then determine a second sensing value based on the sensing information.

For example, the first inflation value can be a maximum inflation value of the inflatable cells 1102 which would raise the patient 804 a first known distance above the sensing conductors 1200 and the second inflation value can be a minimum inflation value of the inflatable cells 1102 which would lower the patient 804 to a second known distance above the sensing conductors 1200. The control module 1202 can then use the known distances and measured values to create a relationship between the measured values (e.g. measured capacitances) and the known distances and can interpolate between the measured values and known distances. If desired, the control module 1202 can also inflate the inflatable cells 1102 to other inflation values that correspond with other known distances.

In another embodiment, the control module 1202 inflates the inflatable cells 1102 (e.g. by increasing the fluid pressure) to a first inflation value (e.g. a maximum inflation value) and determines a first sensing value based on the sensing information. The first sensing value can be used as a baseline value. The control module 1202 can then subsequently reduce the fluid pressure of the inflatable cells 1102 and periodically determine a second sensing value based on the sensing information as the inflatable cells 1102 deflate and lower the patient 804. Once the second sensing value transcends a first predetermined sensing value, the control module 1202 can subsequently increase the fluid pressure of the inflatable cells 1102 and can periodically determine a third sensing value based on the sensing information as the inflatable cells 1102 inflate and raise the patient 804. Once the third sensing value transcends a second predetermined sensing value, the control module 1202 can decrease the fluid pressure until the sensing information transcends the first predetermined sensing value once again. The first and second predetermined sensing values can be determined empirically and can also be based on the baseline value.

The control module 1202 can also determine a position (e.g. a latitudinal and longitudinal position) of the patient 804 along the planar surface 18. In this example, the patient position apparatus 1100 includes a first of the one or more control modules 1202 at a first end 1204 (e.g. a patient foot end) and associated sensing conductors 1200. As shown, the sensing conductors 1200 at the first end 1204 are arranged along a longitudinal axis of the patient position apparatus 1100. In addition, the sensing conductors 1200 at the first end 1202 extend approximately half the length of the patient position apparatus 1100. As such, the control module 1202 can determine whether the patient 804 is positioned proximate the first end 1204 and can also determine whether the patient 804 is positioned along a first edge 1206, a second edge 1208, or in between the first and second edges 1206, 1208. By using the plurality of sensing conductors 1200, the control module 1202 can determine the position of the patient 804 based on the plurality of sensing information and can also interpolate between the sensing information readings by using a centroid type calculation as known in the art. As such, the control module 1202 can determine a substantially accurate position (i.e. an x. and y axis position) of the patient 804 along the planar surface 18. Furthermore, as can be appreciated by those of ordinary skill in the art, increasing the number of sensing conductors 1200 and decreasing the spacing between the sensing conductors 1200 can increase granularity of the position determined by the control module 1202.

Also, in this example, the patient position apparatus 1100 includes a second of the one or more control modules 1202 at a second end 1210 (e.g. a patient head end) and associated sensing conductors 1200. As shown, the sensing conductors 1200 at the second end 1210 are arranged along the longitudinal axis of the patient position apparatus 1100. In addition, the sensing conductors 1200 at the second end 1210 extend approximately half the length of the patient position apparatus 1100. As such, the control module 1202 can determine whether the patient 804 is positioned proximate the second end 1210 and can also determine whether the patient 804 is positioned along the first edge 1206, the second edge 1208, or in between the first and second edges 1206, 1208.

As can be appreciated by those of ordinary skill in the art, the sensing conductors 1200 can be arranged along the planar surface 18 in multiple different ways. For example, rather than longitudinally arranging the conducting sensors 1200 along the patient position apparatus 1100, the conducting sensors 1200 can be arranged latitudinally along the patient position apparatus 1100 or both latitudinally and longitudinally along the patient position apparatus 1100 if desired.

In some cases it can be undesirable for a patient to be positioned along the first or second edge 1206, 1208 of the patient support apparatus 14. For example, if the patient 804 is positioned substantially along the first or second edge 1206, 1208, the patient 804 could be pinned between the side safety panel 20 and the edge 1206, 1208 of the patient support apparatus 14. In addition, it can be desirable for certain pulmonary patients to be positioned near the center of the patient support apparatus 14 rather than either edge 1206, 1208. As such, the control module 1202 can provide alarm information to the therapy control module 21 via the communication path 22. When received by the therapy control module 21, the alarm information can be used to notify a nurse or other personnel that the patient 804 is positioned substantially along one of the edges 1206, 1208.

In embodiments that include inflatable cells 1102 having a diagonal seal such as the inflatable cells 300, 302, or 500 shown in FIGS. 3 and 5, the control module 1202 can concurrently increase fluid pressure in a first chamber of the inflatable cell 1102 and decrease fluid pressure in a second chamber of the inflatable cell of 1102 in order to roll the patient 804 towards the center of the patient support apparatus 14. For example, if the inflatable cell 1102 corresponds with the inflatable cell 300 in FIG. 3, the control module can concurrently increase fluid pressure of the inflatable chamber 310 and decrease fluid pressure of the inflatable chamber 312 or vice versa. In this manner, the patient 804 can be rolled from one of the edges 1206, 1208 towards the center of the patient support apparatus 14.

Although the control module 1202 is included in the patient position apparatus 1100 in this example, those of ordinary skill in the art can appreciate that the functionality of the control module 1202 can be incorporated into the therapy control module 21 if desired.

Figure 13:
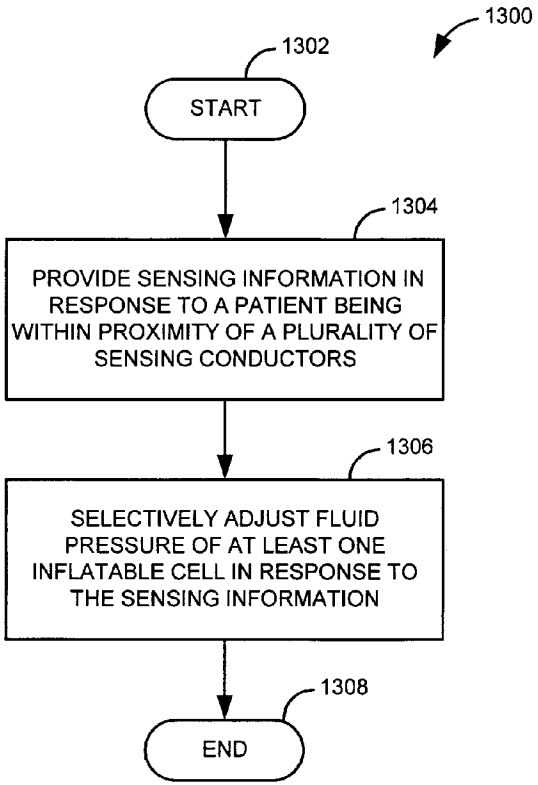
FIG. 13 is a flowchart depicting exemplary steps they can be taken by a control module associated with the patient position apparatus.

Referring now to FIG. 13, exemplary steps that can be taken by the control module 1202 to maintain a predetermined distance between the patient 804 and the patient position apparatus 1100 are generally identified at 1300. The process starts in step 1302. In step 1304, the sensing conductors 1200 provides sensing information in response to the patient 804 being within proximity of the sensing conductors 1200. In step 1306, the control module 1202 selectively adjusts fluid pressure of the inflatable cells 1102 in response to the sensing information. The process ends in step 1308.

As noted above, among other advantages, the patient position apparatus and method maintain a predetermined position between a patient and the patient position apparatus, which is desirable for, inter alia, preventing and curing bedsores. In addition, the patient position apparatus and method can determine a position of the patient along the planar surface of the patient support apparatus, which can be used to alert personnel when the patient is positioned in an undesirable area (e.g. an edge of the patient support apparatus). Furthermore, the patient position apparatus and method can selectively adjust fluid pressure of inflatable cells of the patient support apparatus in order to roll the patient from an undesirable area (e.g. an edge of the patient support apparatus) to a desirable area (e.g. center of the patient support apparatus). Other advantages will be recognized by those of ordinary skill in the art.

While this disclosure includes particular examples, it is to be understood that the disclosure is not so limited. Numerous modifications, changes, variations, substitutions, and equivalents will occur to those skilled in the art without departing from the spirit and scope of the present disclosure upon a study of the drawings, the specification, and the following claims.

What is claimed is:

1. A patient position apparatus, comprising:

a support surface;

a plurality of sensing conductors made of conductive material, arranged in spaced-apart, elongated strips along a substantially planar surface of the support surface, that are operative to provide sensing information in response to a patient being within proximity of the plurality of sensing conductors; and a control module, operatively coupled to the plurality of sensing conductors, that is operative to selectively adjust fluid pressure of at least one inflatable cell in response to the sensing information.

2. The patient position apparatus of claim 1 wherein the control module is operative to determine a distance between the patient and the plurality of sensing conductors based on the sensing information wherein the sensing information is capacitance sensing information.

3. The patient position apparatus of claim 2 wherein the control module is operative to determine a relationship between the distance and the sensing information.

4. The patient position apparatus of claim 2 wherein the control module is operative to increase the fluid pressure when the distance is less than a predetermined distance and to decrease the fluid pressure when the distance is greater than the predetermined distance.

5. The patient position apparatus of claim 1 wherein the control module is operative to determine a position of the patient along the substantially planar surface.

6. The patient position apparatus of claim 5 wherein the control module is operative to provide alarm information when the position of the patient is substantially along an edge of the substantially planar surface.

7. The patient position apparatus of claim 5 wherein the at least one inflatable cell comprises a first and second inflatable chamber and the control module is operative to concurrently increase fluid pressure in the first chamber and decrease fluid pressure in the second chamber when the position of the patient is substantially along an edge of the substantially planar surface.

8. A patient support apparatus, comprising:

a plurality of inflatable cell forming a substantially planar surface;

a plurality of sensing conductors made of conductive material, beneath the plurality of one inflatable cells and arranged in spaced-apart, elongated strips along a substantially planar support surface, that are operative to provide sensing information in response to a patient being within proximity of the plurality of sensing conductors; and a control module, operatively coupled to the plurality of sensing conductors, that is operative to selectively adjust fluid pressure of the plurality of inflatable cell based on the sensing information.

9. The patient support apparatus of claim 8 wherein the control module is operative to determine a distance between the patient and the plurality of sensing conductors based on the sensing information.

10. The patient support apparatus of claim 9 wherein the control module is operative to determine a relationship between the distance and the sensing information.

11. The patient support apparatus of claim 9 wherein the control module is operative to increase the fluid pressure when the distance is less than a predetermined distance and to decrease the fluid pressure when the distance is greater than the predetermined distance.

12. The patient support apparatus of claim 8 wherein the control module is operative to determine a position of the patient along the substantially planar surface.

13. The patient support apparatus of claim 12 wherein the control module is operative to provide alarm information when the position of the patient is substantially along an edge of the substantially planar surface.

14. The patient support apparatus of claim 12 wherein the at least one inflatable cell comprises a first and second inflatable chamber and the control module is operative to concurrently increase fluid pressure in the first chamber and decrease fluid pressure in the second chamber when the position of the patient is substantially along an edge of the substantially planar surface.

15. A method, comprising:

providing sensing information in response to a patient being within proximity of a plurality of capacitive sensing conductors made of conductive material and arranged in spaced-apart, elongated strips; and selectively adjusting fluid pressure of at least one inflatable cell in response to the sensing information.

16. The method of claim 15 further comprising determining a distance between the patient and the plurality of capacitive sensing conductors based on the sensing information.

17. The method of claim 16 further comprising determining a relationship between the distance and the sensing information.

18. The method of claim 16 further comprising:

increasing the fluid pressure when the distance is less than a predetermined distance; and decreasing the fluid pressure when the distance is greater than the predetermined distance.

19. The method of claim 15 further comprising determining a position of the patient along the substantially planar surface.

20. The method of claim 19 further comprising providing alarm information when the position of the patient is substantially along an edge of the substantially planar surface.

21. The method of claim 19 further comprising concurrently increasing fluid pressure in a first chamber of the at least one inflatable cell and decreasing fluid pressure in a second chamber of the at least one inflatable cell when the position of the patient is substantially along an edge of the substantially planar surface.

22. A patient position apparatus, comprising:

a plurality of sensing conductors, arranged along a substantially planar surface, that are operative to provide sensing information in response to a patient being within proximity of the plurality of sensing conductors;

a control module, operatively coupled to the plurality of sensing conductors, that is operative to selectively adjust fluid pressure of at least one inflatable cell in response to the sensing information;

wherein the control module is operative to:

determine a distance between the patient and the plurality of sensing conductors based on the sensing information;

determine a relationship between the distance and the sensing information; and determine the relationship by inflating the at least one inflatable cell to a first inflation level and determining a first sensing value based on the sensing information at the first inflation level and then subsequently inflating the at least one inflatable cell to a second inflation level and determining a second sensing value based on the sensing information at the second inflation level.

23. A patient support apparatus, comprising:

at least one inflatable cell forming a substantially planar surface;

a plurality of sensing conductors, beneath the at least one inflatable cell and arranged along the substantially planar surface, that are operative to provide sensing information in response to a patient being within proximity of the plurality of sensing conductors;

a control module, operatively coupled to the plurality of sensing conductors, that is operative to selectively adjust fluid pressure of the at least one inflatable cell based on the sensing information;

wherein the control module is operative to:

determine a distance between the patient and the plurality of sensing conductors based on the sensing information;

determine a relationship between the distance and the sensing information; and determine the relationship by inflating the at least one inflatable cell to a first inflation level and determining a first sensing value based on the sensing information at the first inflation level and then subsequently inflating the at least one inflatable cell to a second inflation level and determining a second sensing value based on the sensing information at the second inflation level.

24. A method, comprising:

providing sensing information in response to a patient being within proximity of a plurality of sensing conductors;

selectively adjusting fluid pressure of at least one inflatable cell in response to the sensing information;

determining a distance between the patient and the plurality of sensing conductors based on the sensing information;

determining a relationship between the distance and the sensing information;

wherein the relationship is determined by:

inflating the at least one inflatable cell to a first inflation level and determining a first sensing value based on the sensing information at the first inflation level; and subsequently inflating the at least one inflatable cell to a second inflation level and determining a second sensing value based on the sensing information at the second inflation level, wherein the first inflation level is greater than the second inflation level.

* * * * *